United States Patent [19]

Goto

[11] 4,273,019

[45] Jun. 16, 1981

[54] ELECTRONIC TONE GENERATOR

[75] Inventor: Mitsuhiro Goto, Suwa, Japan

[73] Assignee: Kabushiki Kaisha Suwa Seikosha, Tokyo, Japan

[21] Appl. No.: 56,155

[22] Filed: Jul. 10, 1979

[30] Foreign Application Priority Data

| | | | |
|---|---|---|---|
| Jul. 11, 1978 | [JP] | Japan | 53-84306 |
| Jul. 11, 1978 | [JP] | Japan | 53-84308 |
| Jul. 11, 1978 | [JP] | Japan | 53-84309 |
| Jul. 11, 1978 | [JP] | Japan | 53-84310 |

[51] Int. Cl.[3] ..... G10H 1/043; G10H 1/10

[52] U.S. Cl. ..... 84/1.24; 84/DIG. 4; 84/DIG. 11; 84/DIG. 26

[58] Field of Search ..... 84/1.01, 1.03, 1.11, 84/1.19, 1.22, 1.24, DIG. 4, DIG. 26, DIG. 11

[56] References Cited

U.S. PATENT DOCUMENTS

| | | | |
|---|---|---|---|
| 3,549,777 | 12/1970 | Bunger | 84/1.03 |
| 3,610,801 | 10/1971 | Fredkin et al. | 84/1.03 |
| 3,816,637 | 6/1974 | Whitefield | 84/1.24 |
| 3,842,702 | 10/1974 | Tsundoo | 84/1.01 |
| 3,890,871 | 6/1975 | Oberheim | 84/1.01 |
| 3,939,751 | 2/1976 | Harasek | 84/1.01 X |
| 3,978,755 | 9/1976 | Woron | 84/1.24 |
| 4,014,167 | 3/1977 | Hasegawa et al. | 84/1.03 X |
| 4,055,103 | 10/1977 | Machanian | 84/1.01 |
| 4,058,043 | 11/1977 | Shibahara | 84/1.03 |
| 4,085,645 | 4/1978 | Ryon | 84/1.01 |
| 4,122,742 | 10/1978 | Deutsch | 84/1.11 |
| 4,173,164 | 11/1979 | Adachi et al. | 84/1.19 |
| 4,186,637 | 2/1980 | Swain et al. | 84/1.01 |
| 4,215,616 | 8/1980 | Gross | 84/1.01 |
| 4,217,801 | 8/1980 | Wilcox et al. | 84/1.01 |

*Primary Examiner*—S. J. Witkowski

*Attorney, Agent, or Firm*—Blum, Kaplan, Friedman, Silberman and Beran

[57] ABSTRACT

An electronic tone or note generator capable of providing improved musical and tone quality and special sound effects by mixing the outputs of a plurality of note-signal-producing circuits is provided. The electronic tone or note generator of the invention is characterized by the use of a primary electronic note circuit for producing a primary note signal which is a portion of a primary melody, and a secondary electronic note circuit for producing a secondary note signal that is musically related to the primary melody. The relationship between signals can be a time lag between the outputs of the two note signal circuits or a small difference in frequency between the signal outputs of the two note circuits. Additionally, each note signal circuit can output alternate notes of a continuing melody such that a note from one circuit may persist while the next note from the second circuit is played. The note signals from the note-producing circuits are shaped and mixed or summed and then applied to an electroacoustic transducer in order to produce audible music of high sound quality. The acoustical frequency of each note and the time between initiation of successive notes are stored in memory units associated with each note-signal-producing circuit. The outputs of high-frequency signal sources are variably divided down to provide the individual note signals and control note timing.

29 Claims, 18 Drawing Figures

ELECTRONIC TONE GENERATOR

BACKGROUND OF THE INVENTION

This invention is directed to an electronic tone generator for producing higher-quality music and, in particular, to an electronic tone generator utilizing a primary electronic note-producing circuit and a secondary note-producing circuit for respectively producing note signals that are related with respect to each other in order to provide special sound effects.

Tone generators fabricated entirely of electronic components have been proposed heretofore. It is noted, however, that music produced by available electronic tone generators has a monotone quality and therefore is inferior in quality to the music produced by a good mechanical music generator of the type incorporated in a music box. Because of the inferior musical quality provided by the electronic tone generators of the prior art, the numerous advantages which an electronic tone generator can provide over a conventional mechanical music box have not as yet been fully appreciated. For example, mechanical tone generators are generally limited to a single tune, whereas electronic tone generators can be reprogrammed to perform any of a plurality of tunes. Similarly, electronic tone generators not only eliminate the use of mechanical winding springs, but additionally, the tempo of the music can be selectively varied.

Accordingly, what is needed is an electronic tone generator capable of producing music that compares in tonal quality with a good mechanical tone generator of the type used in a music box. Also, it is desirable that the good tonal quality be combined with the advantages of electronic circuitry in allowing reprogramming of the melody and the elimination of cumbersome mechanical parts such as winding springs.

SUMMARY OF THE INVENTION

Generally speaking, in accordance with the instant invention, an electronic tone or note generator for producing a melody having improved musical and tone quality and special sound effects is provided. The electronic tone or note generator of this invention provides the improved musical and tone quality and special sound effects by mixing the outputs of a plurality of note-signal-producing circuits. The electronic tone or note generator is characterized by the use of a primary electronic note circuit for producing a primary note signal which is a portion of a primary melody, and a secondary electronic note circuit for producing a secondary note signal that is musically related to the primary melody. The relationship between signals can be a time lag between the outputs of the two note signal circuits or a small difference in frequency between the signal outputs of the two note circuits. Additionally, each note signal circuit can output alternate notes of a continuing meolody such that a note from one circuit may persist while the next note from the second circuit is played. The note signals from the note-producing circuits are shaped and mixed or summed and then applied to an electroacoustic transducer in order to produce audible music of high sound quality. The acoustical frequency of each note and the time between initiation of successive notes are stored in memory units associated with each note-signal-producing circuit. The outputs of high-frequency signal sources are variably divided down to provide the individul note signals and to control note timing.

The note signals can be shaped and given an envelope so as to synthesize sounds similar to different musical instruments. Simple circuitry creates note signals having many of the characteristics of signals produced by the actual instruments.

Accordingly, it is an object of this invention to produce an improved electronic tone or note generator that produces more acoustically pleasing music.

Another object of the instant invention is to provide an improved electronic tone or note generator that produces music with special sound effects.

Still another object of this invention is to provide an improved electronic tone or note generator wherein one note may be produced concurrently with the sounding of another note.

Yet another object of the instant invention is to provide an improved electronic tone or note generator wherein successive notes in the same melody overlap in sound.

A further object of the instant invention is to provide an improved electronic tone or note generator which outputs signals including a beat frequency or an echo effect.

An additional object of the instant invention is to provide an improved electronic tone or note generator that simultaneously plays two independent melodies, one melody having special sound effects.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWING

For a fuller understanding of the invention, reference is had to the following description taken in connection with the accompanying drawing, in which.

DESCRIPTION OF THE PREFERRED EMBODIMENTS

Figure 1:
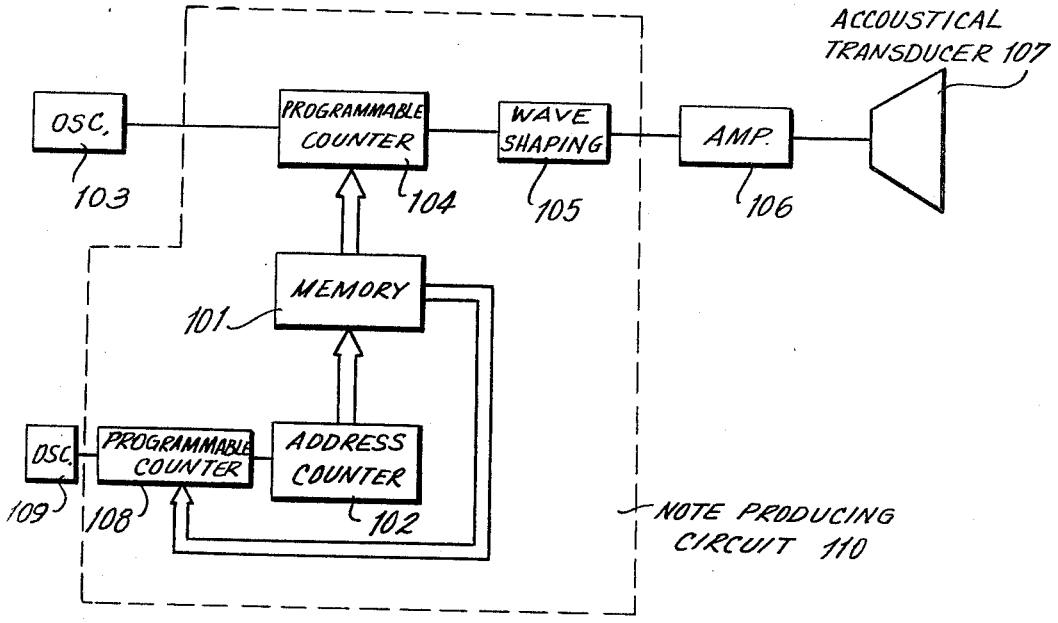
FIG. 1 is a functional block diagram of an electronic tone generator having one note-producing circuit.

The electronic tone generator of this invention provides melodies having an acoustically pleasing tone. FIG. 1 shows a basic functional block diagram of an electronic tone generator wherein note and time data, which are stored in a memory circuit 101, control programmable counters 104, 108, and a predetermined musical note is obtained by dividing the clock pulses outputted from a high-frequency signal oscillator circuit. A sequence of selected notes provides a melody. The note information stored at a plurality of addresses in the memory circuit 101 is read out successively from each address in response to an address signal applied to the memory circuit 101 by an address counter 102. In order to produce a desired musical note, a programmable counter 104 divides down the output clock pulses produced by the high-frequency oscillator circuit 103 in accordance with the data related to the musical note which is stored in the memory circuit 101. The division ratio in the programmable counter 104 is varied so that all musical notes of different frequency may be produced upon command from the memory unit 101. A wave-shaping circit converts the selected frequency electrical signal outputted by the programmable counter 104 and gives it a selected wave form, for example, sinusoidal, rectangular, saw-toothed and applies a selected modulating envelope to the outputted signal, for example, a decaying envelope. Then the shaped electronic signal wave form is amplified in the amplifier circuit 106 and the output of the amplifier 106 is converted to an acoustical output as a musical sound by an electroacoustic transducer 107.

Each musical note is controlled in its duration until the occurrence of the next musical note in the same note-producing circuit. Data for the duration of each musical note are read out of the memory circuit 101 simultaneously with the data readout which identifies the audio frequency of the musical note. A programmable counter 108 divides clock pulses supplied from an oscillator circuit 109. The division ratio of the programmable counter 108 is variable in response to the time or duration signals supplied from the memory circuit 101. As an example, the oscillator circuit 109 can produce pulses having a period representative of the shortest duration of a musical note used in constructing the melody. When that shortest note, for example, a sixteenth note, occurs in the melody, the programmable counter 108 would provide a one-to-one ratio, and an output signal from the programmable counter 108 would occur after only one cycle of the oscillator 109. The output from the programmable counter 108 is input to the address counter 102, which causes the data for the next musical note in the melody to be read out of the memory 101. Thus, the counter 108 determines the duration of each individual musical note and, by advancing the address counter 102, controls the timing when each musical note is read out of memory 101. It should be understood that if the musical score includes a rest, then no signal is outputted from the programmable counter 104, but the duration of the rest would be controlled by the programmable counter 108 as in the case where an actual musical note is being produced. To continue with the above example, when an eighth note occurs in the musical score, the division ratio of the programmable counter 108 is changed to two to one, so that two cycles of the oscillator 109 occur before the programmable counter 108 changes the address in the address counter 102 and initiates the next note of the melody. It should be understood that the circuit 109 described above as an oscillator circuit may in an alternative emboodiment of this invention be a circuit which divides clock pulses supplied from the oscillator circuit 103. Thus, a single oscillator circuit may serve both functions, that is, the functions of producing musical notes of different acoustical frequencies and providing a timing of the sequence of consecutive notes.

The sound quality produced by such an electronic tone generator as described above has a monotone quality, and the music produced thereby is inferior to that produced by a mechanical music box. The electronic tone generator of this invention produces higher-quality music, and the electronic tone generator of this invention can be put to other practical uses as well.

Figure 2:
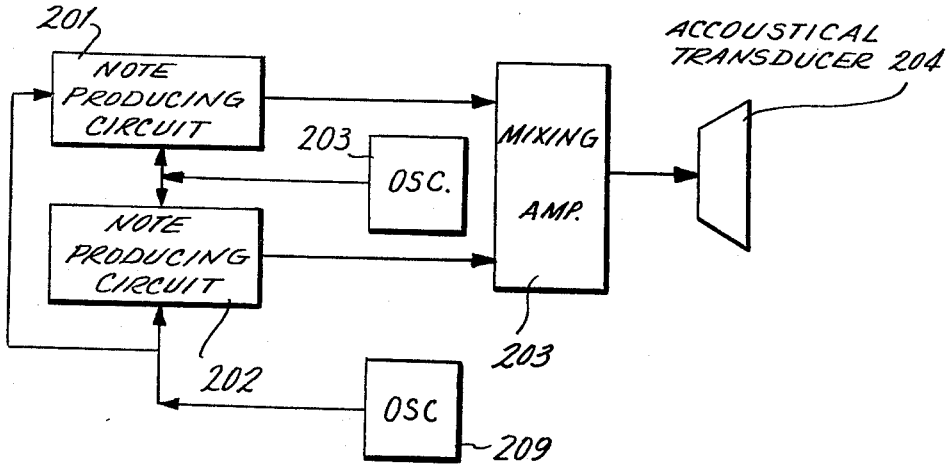
FIG. 2 is a functional block diagram of an electronic tone generator in accordance with this invention.

A functional block diagram of an electronic tone generator in accordance with this invention is shown in FIG. 2. In this invention, at least two musical-note-producing circuits 201, 202, which are the same as the note producer 110 of FIG. 1, are utilized. The electrical signal wave forms produced respectively by the note-producing circuits 201, 202 are combined and amplified in a mixing-amplifier circuit 203 and are then transmitted to an electroacoustical transducer 204 which emits an acoustical musical sound. The transducer 204 may be, for example, a conventional loudspeaker. The musical notes are produced by respective note-producing circuits 201, 202, as described below. The first musical-note-producing circuit 201 produces notes of a desired melody. The audio frequency of the musical note produced by the first note-producing circuit 201 may be designated as f. Then, the second note-producing circuit 202 produces a note having an audio frequency of $f \pm \Delta f$. The range of $\Delta f$, which depends on the notes which are being played, is desirably from 3 to 30 Hz in those instances where the audio frequency of the notes is in a range from several hundred Hz to several thousand Hz. Although it depends on the tune which is being played, a signal of $f + \Delta f$ is generally better than a signal of $f - \Delta f$ in providing good sound effects.

The programmable counters in the note-generating circuits 201, 202 of FIG. 2, corresponding to the programmable counter 104 of FIG. 1, output signals having a rectangular wave form. Wave-shaping circuits are used in the note-producing circuits 201, 202 corresponding to the wave-shaping circuit 105 of FIG. 1. These wave-shaping circuits change the rectangular wave outputs from the programmable counters and convert them, for example, into sine or triangular saw-toothed wave forms. Notes using different wave forms although of the same frequency have different tonal output qualities and produce pleasing effects. When using the rectangular wave form from the programmable counters, circuit construction is simplified and the circuit elements are easily integrated. Thus, an electronic tone generator in accordance with this invention can be widely applied to portable electronic products. The oscillators 203, 209 for note and timing signals respectively each serve both note-producing circuits 201, 202 to further simplify the construction. Where, as described hereinafter, more than two note-producing circuits are used, common oscillators may serve every note-producing circuit.

In addition to altering the tonal quality by selecting the wave shape of each cycle of the audio frequency, further acoustical enhancement of the tone can be achieved by applying proper envelopes to the basic audio-frequency wave forms each time a musical note is produced. The envelope provides an amplitude modulation for the audio-frequency signals comprising a musical note. The envelope wave form for an actual musical instrument is generally composed of portions, namely, attack, decay, sustenance and release. In the tone generator of this invention, the envelope wave form is composed only of the attack (A) and release (R) portions, that is, an AR-type envelope. The decay and sustenance portions are not reproduced. This approach is better in maintaining a simple circuit construction. Especially when rectangular waves are used as a basic wave form for the audio signals, the addition of an AR-type envelope provides a good acoustical effect.

Figure 3:
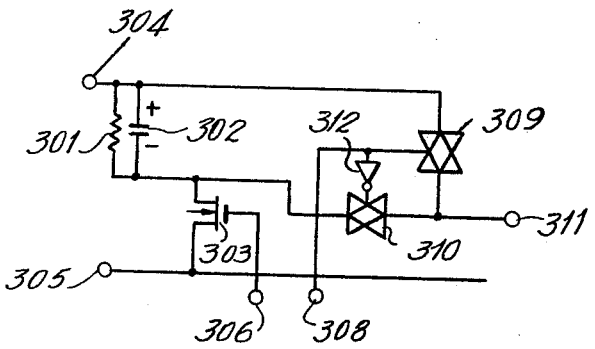
FIG. 3 is a circuit for applying envelopes to electronic signals.
Figure 4:
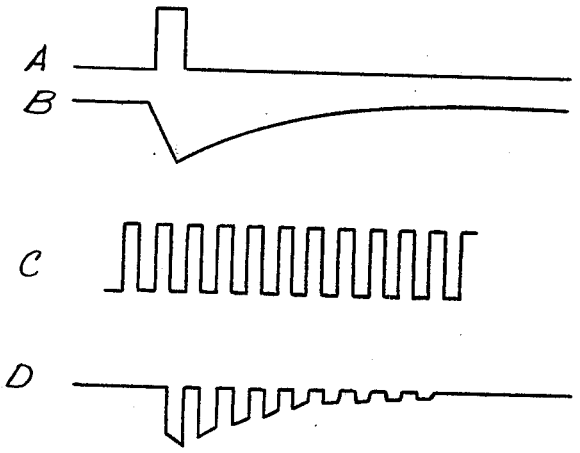
FIG. 4 shows wave forms associated with the circuit of FIG. 3.

FIG. 3 is a circuit for applying envelopes to the rectangular wave signals emanating from the programmable counter in each note-generator circuit 201, 202 corresponding to the programmable counter 104 in FIG. 1. A resistor 301 and a capacitor 302 are connected in parallel. One end of the resistor 301 is connected to one terminal of an N-channel MOS transistor 303, used as a switch, and the other terminal of the transistor 303 is connected to a negative power terminal 305. The other end of the resistor 301 is connected to the positive terminal 304 of the power source. A signal wave form for the attack portion of a note, as shown by curve A of FIG. 4, is applied to the input terminal 306 connected to the gate of the N-channel MOS transistor 303. When the potential at the gate terminal 306 is high, the potential at terminal 307 changes due to the on-resistance of the N-channel MOS transistor 303 as shown by curve B of FIG. 4. When the potential at the gate terminal 306 goes low, the N-channel MOS transistor 303 is turned off and the electrical charge which has accumulated in the capacitor 302 is discharged through the resistor 301. This signal (curve C of FIG. 4), to which envelopes are applied in the circuit of FIG. 3, is input at terminal 308. The signals C at terminal 308 are the output of the programmable counter, for example, programmable counter 104 of FIG. 1. Note that the capacitor 302 charges up through the resistance of the MOS transistor 303 but discharges through the larger resistor 301. Thus, the potential B at terminal 307 shows a rapid decline and a much slower recovery.

The rectangular wave C is applied directly to the transmission gate 309 and is inverted in its application to transmission gate 310 due to the action of the intermediate inverter 312. The signal C at terminal 308 alternately turns the transmission gates 309, 310 on and off. The output terminal 311 is connected to the positive terminal 304 when the transmission gate 309 is closed, and the output terminal 311 is connected to terminal 307 when the transmission gate 310 is closed and gate 309 is open. Accordingly, the signal at the output terminal 311 has the wave form as shown in curve D of FIG. 4, that is, the frequency signal of curve C has an envelope corresponding to the wave form of curve B. It should be apparent that if the power terminals are reversed in polarity in the circuit of FIG. 3, the polarity of the envelope will also be reversed. In comparing the wave form D of FIG. 4 with the wave form produced by an actual musical instrument, it will be noted that the wave form in accordance with the circuit of FIG. 3 is composed only of attack and release portions. It is possible to provide a wave-form envelope which is composed of the four elements, namely, attack, decay, sustenance and release, by using a more-complicated circuit structure (not shown). It is desirable to set the time constants of the envelope-producing circuits so as to make musical notes from the respective note-producing circuits which, as described more fully hereinafter, overlap. The enveloped signal wave forms produced independently by the two note-producing circuits, as described above, are applied to a mixing amplifier circuit and then are transmitted to an electroacoustical transducer where audible sound is produced corresponding to the notes of the melody.

Where, as described above, there is a difference of $\Delta f$ between the frequency of the musical notes from the two note-producing circuits, but otherwise the notes are substantially the same, a beat frequency occurs in the tones outputted by the electroacoustical transducer. Thereby, a more-pleasing acoustical electronic sound is generated. It should be understood that it is not necessary to maintain this difference in frequency $\Delta f$ between the produced signals throughout the entire melody. The application of the frequency difference $\Delta f$ to only selected bars of the music is considered to fall within the scope of this invention. Because all circuit elements of the tone generator of this invention can be formed of integrated circuit elements, with the exception of the electroacoustical transducer and perhaps a small number of resistors and capacitors, the electronic tone generator of this invention can be widely applied for alarm functions in portable electronic products as well as in industrial electronic products. In particular, an electronic timepiece having an electronic sound-producing function can be produced without increasing the number of manufacturing process steps by integrating the circuit of this invention on the same circuit chip together with the circuitry for the timekeeping functions.

In an alternative embodiment of this invention, the first note-producing circuit 201 produces musical notes in succession corresponding to the melody, and the second note-producing circuit 202 is adapted to produce the same notes but with the note generated by the second note-producing circuit 202 being delayed by a certain fixed amount after the notes produced by the first note-producing circuit 201. The delay time $\Delta t$ can be varied, but in an embodiment which had pleasing tone qualities, the delay time $\Delta t$ was equal to half the duration of the shortest note occurring in the melody. For example, if an eighth note was the shortest note in a melody, the delay time $\Delta t$ would have a duration equivalent to a sixteenth note.

Figure 5:
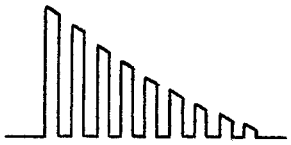
FIG. 5 is a note signal with a tapered envelope.

It should be noted that even in the embodiment using a delay between the outputs of the two note-producing circuits 201, 202, the wave-shaping circuits are used to put an envelope on the audio-frequency signals. Additionally, the wave shape of the signals can be rectangular, sinusoidal or triangular sawtooth as examples for use in audio reproduction. The following example is presented using envelopes as depicted in FIG. 5, which are similar to those described above in conjunction with the circuit of FIG. 3. It should be understood that with such an envelope produced by an RC network, the musical note produced by one circuit will continue to decay until another note is produced by that same circuit.

Figure 6:
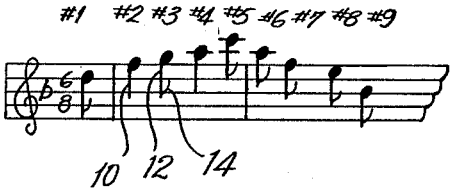
FIG. 6 is an example of a musical score for providing a melody.

FIG. 6 is a portion of a melody in conventional written format. A note 10 has twice the duration of a note 12 which is characterized by a flag 14 at the lower end. The signal produced by the note-producing circuit 201 corresponds to the wave form A of FIG. 7 and shows a peak #1 corresponding to note 1, followed by a peak #2 corresponding to note 2, followed by a peak #3 corresponding to note 3. Between the peaks is a period of exponential decay produced by an RC network as described above. The occurrence of a note terminates the envelope of the preceding note. It should be apparent that the spacing between the peaks of notes 1 and 2 is less than the spacing between the peaks of notes 2 and 3 for the reason stated above that note 2 is of longer duration than note 1. In the melody of FIG. 6, only notes 2 and 4 are longer in duration than the remaining notes of the melody presented as an example. It should be understood that within each envelope occurs the wave form as illustrated, for example, by FIG. 5. Thus, each note represents a particular audio frequency depending upon its location on the musical staff, as is well known to those skilled in the musical arts.

Figure 7:
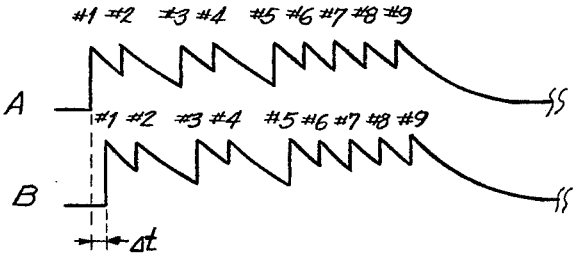
FIG. 7 illustrates output wave forms produced by separate note-producing circuits in the tone generator of FIG. 2.

The wave form B of FIG. 7 duplicates the wave form A of the same Figure except that the wave form B is offset by a time $\Delta t$ from the wave form A. A delay in changing the address in the address counter is one of many means for providing a delay in the second note-producing circuit 202.

In this embodiment of the invention, the delay between the two signals which are mixed in the mixing amplifier 203 and sonically reproduced in the acoustical transducer 204, produces an echo effect which is acoustically pleasing as compared to the implementation where only one note-producing circuit provides a primary melody. This type circuit can also be produced economically using integrated circuits.

It should be further understood that more than two note-producing circuits may be used to play the same melody, with each circuit having a different delay from the first circuit. The result is acoustically pleasing. Also, it should be understood that the echo effect may be applied to an entire melody or to selected bars of the melody without deviating from the scope of this invention.

Figure 8:
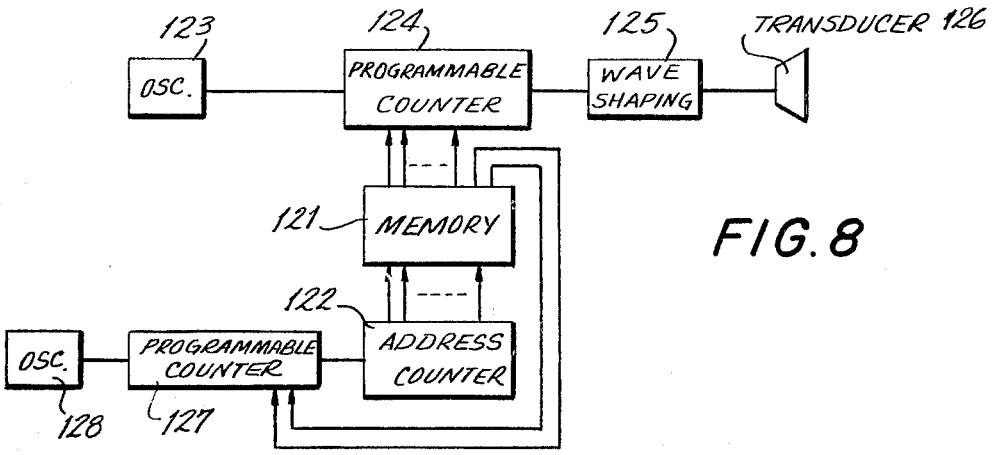
FIG. 8 is a functional block diagram similar to FIG. 1.

Another alternative embodiment of this invention is shown in FIG. 8. Note and time data which are stored in a memory circuit 121 control programmable counters 124, 127, and a predetermined musical note is obtained by dividing the clock pulses outputted from a high-frequency-signal oscillator circuit. A sequence of selected notes provides a melody. The note information stored at a plurality of addresses in the memory circuit 121 is read out successively from each address in response to an address signal applied to the memory circuit 121 by an address counter 122. In order to produce a desired musical note, a programmable counter 124 divides down the output clock pulses produced by the high-frequency oscillator circuit 123 in accordance with the data related to the musical note which is stored in the memory circuit 121. The division ratio in the programmable counter 124 is varied so that all musical notes of different frequency may be produced upon command from the memory unit 121. A wave-shaping circuit 125 converts the selected counter frequency signal outputted by the programmable counter 124 and gives it a desired wave form, for example, sinusoidal, rectangular, sawtoothed, and applies a selected modulating envelope to the outputted signal, for example, a decaying envelope. Then the shaped electronic signal wave form is converted to an acoustical output as a musical sound by an electroacoustic transducer 126.

Each musical note is controlled for its duration until the occurrence of the next musical note. Data for the duration of each musical note prior to the initiaton of the next note are read out of the memory circuit 121 simultaneously with the readout of the above-described musical note data which controls the audio frequency of the note. A programmable counter 127 divides clock pulses supplied from an oscillator circuit 128. The division ratio of the programmable counter 127 is variable in response to the time or duration signal supplied from the memory circuit 121. As an example, the oscillator circuit 128 can produce pulses having a period representative of the shortest duration of a musical note used in constructing the melody. When that shortest note, for example, a sixteenth note, occurs in the melody, the programmable counter 127 would provide a one-to-one ratio, and an output signal from the programmable counter 127 would occur after only one cycle of the oscillator 128. The output from the programmable counter 127 is input to the address counter 122, which causes the data for the next musical note in the melody to be read out of the memory 121. Thus, the counter 127 determines the duration of each individual musical note and, by advancing the address counter 122, controls the timing when each musical note is read out of memory 121.

It should be understood that if the musical score includes a rest, then no signal is outputted from the programmable counter 124, but the duration of the rest would be controlled by the programmable counter 127 as in the case where an actual musical note is being produced. To continue with the above example, when an eighth note occurs in the musical score, the division ratio of the programmable counter 127 is changed to two-to-one, so that two cycles of the oscillator 128 occur before the programmable counter 127 changes the address in the address counter 122 and initiates the next note in the melody. It should be understood that the circuit 128 described above as an oscillator circuit may in an alternative embodiment of this invention be a circuit which divides clock pulses supplied from the oscillator circuit 123. Thus, a single oscillator circuit may serve both functions, that is, the function of producing musical notes of different acoustical frequencies and also providing a timing of the sequence of consecutive notes.

The sound quality produced by such an electronic tone generator as described immediately above has a monotone characteristic, and the music produced thereby is inferior to that produced by a good mechanical music box. The electronic tone generator of this invention produces higher-quality music, and the electronic tone generator of this invention can be put to other practical uses as well.

Figure 9:
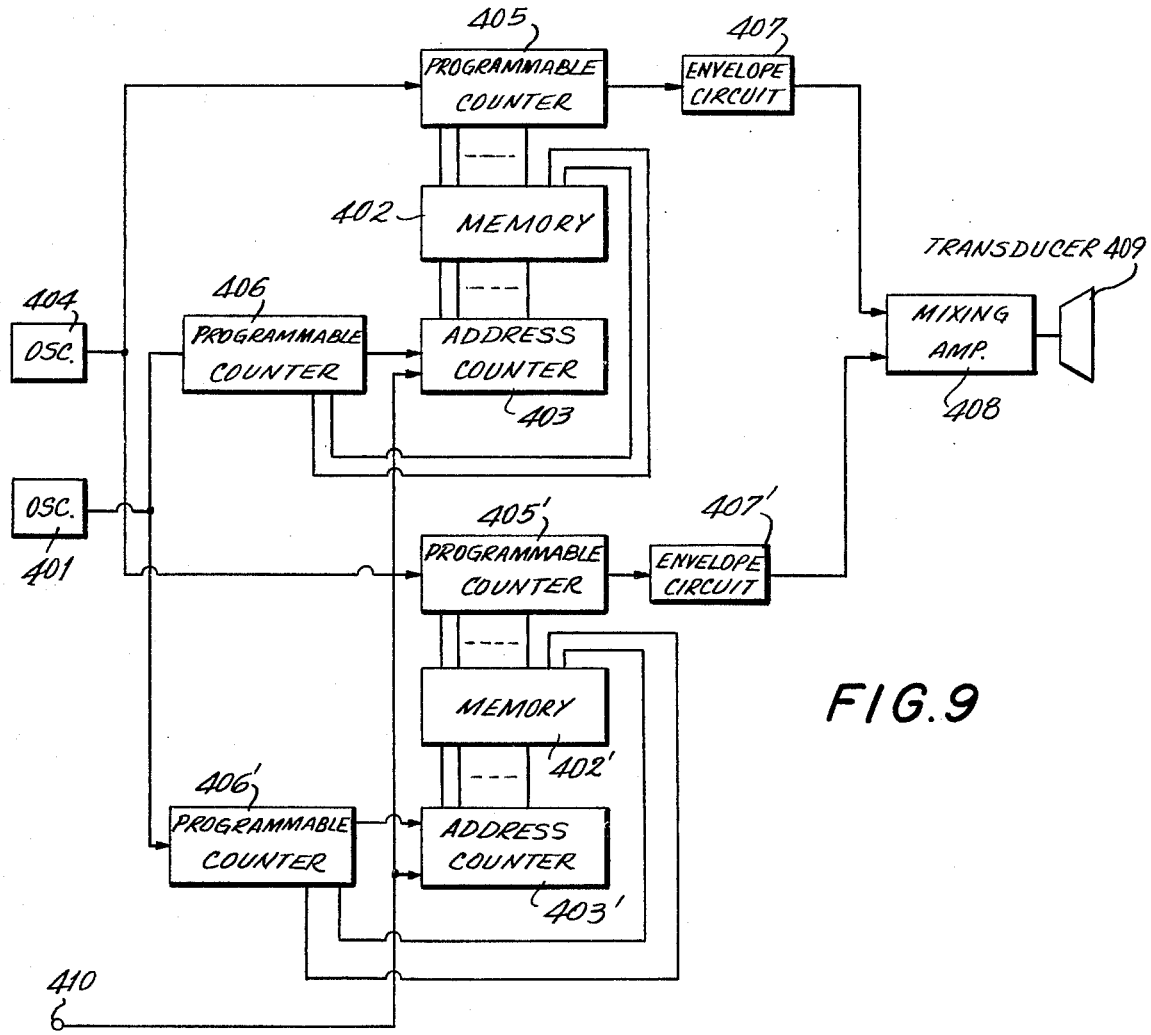
FIG. 9 is a functional block diagram of the electronic tone generator of this invention.

A functional block diagram of an electronic tone generator in accordance with this alternative embodiment of the invention is shown in FIG. 9. The electronic tone generator comprises a clock generating oscillator circuit 401 producing a clock pulse signal having a period representative of the note of shortest duration in time of any note in any tune to be played on the generator of this embodiment. Two memory circuits 402, 402' store the note and time information, and two address counters 403, 403' apply address signals to the memory circuits 402, 402', repectively. Programmable counters 405, 405' divide clock pulses supplied from a clock-signal-generating oscillator circuit 404 in order to produce given notes on the basis of the note information stored in the memory circuits 402, 402'. Programmable counters 406 and 406' divide down clock pulses supplied from the clock generating oscillator circuit 401 according to the note duration information stored in the memory circuits 402, 402' in order to obtain the duration of each note.

Two envelope circuits 407, 407' apply envelopes to the note signals, and a mixing amplifier circuit 408 properly mixes and amplifies the shaped output signals from the envelope circuits 407, 407'. An electroacoustic transducer 409 transmits as an audible musical sound the composite signal supplied from the mixing amplifier circuit 408. A synchronizing signal supplied at an input terminal 410 synchronizes the operation of the two address counters 403, 403'. It will be apparent that the two note-producing circuits of FIG. 9 are substantially similar in construction to the note-producing circuits of FIGS. 1 and 8.

The operation of the electronic tone generator of FIG. 9 is described hereinafter. The division ratios of the programmable counters 405, 405' do not vary so long as the respective outputs from the address counters 403, 403' are not changed. Nevertheless, the programmable counters 405, 405' can produce a graduated series of musical tones having the same amplitude by varying the division ratios in the counters 405, 405'. In the memory circuit 402 is stored at each address a division ratio for the programmable counter 405. Thus, when the address signals of the address counter 403 are advanced by one, the audio frequency of the next note is produced at the output of the counter 405. Similarly, in the memory circuit 402' is stored at each address a division ratio for the programmable counter 405'. Thus, when the address signals of the address counter 403' are advanced by one, the audio frequency of the next note is produced at the output of the counter 405'.

The tempos at which the address counters 403, 403' are advanced are varied according to the duration of the notes in each note-producing circuit. Namely, in the case where a quaver is the shortest time in the melody, the oscillator 401 is adapted to produce clock pulses having a period equal to a quaver. The memory circuits 402, 402' store data to vary the division ratios of the programmable counters 406, 406' so that the pulses from the oscillator 401 are divided down by one-half in the case of a crotchet or into quarters in the case of a minim, and so forth.

Note audio-frequency data and note duration data are stored in memory. Such data are read out of memory one address at a time. The pulses into the counters 406, 406' are divided down, and programmable counter outputs are applied to the address counters 403, 403' as inputs thereof. Thus, the speed with which the address counters are sequenced is varied by the duration of the note. The audible note signal persists until the memory address is advanced to initiate the next note from that same note-producing circuit.

Figure 10:
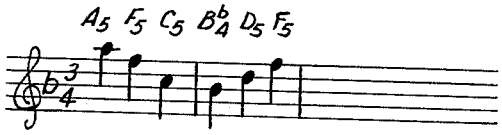
FIG. 10 is a portion of a musical score for a melody.

As described above, the embodiment of this invention (FIG. 9) is provided with two note-producing circuits. Each note-producing circuit produces notes as follows. When providing a melody as shown by the score of FIG. 10, the first note-producing circuit produces the notes identified as $A_5$, $C_5$ and $D_5$, and the second note-producing circuit produces the notes identified as $F_5$, $B\flat_4$ and $F_5$. The melody is split between circuits.

Figure 11:
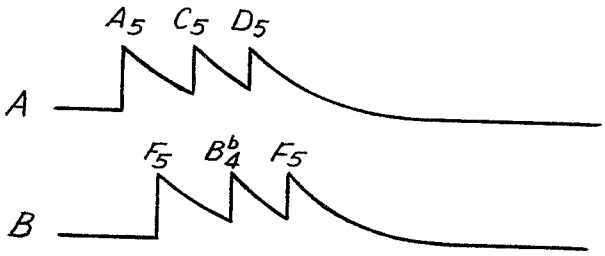
FIG. 11 shows output-envelope wave forms for the melody of FIG. 10 as produced by the tone generator of FIG. 9.

FIG. 11 shows the result when the notes, to which envelopes have been applied, are alternately produced from respective note-producing circuits. Curve A is the output wave form produced by one note-producing circuit. Curve B is the output wave form produced from the other note-producing circuit. Although attach timings to produce notes are shown only by envelope wave forms in FIG. 11, in actuality, the wave forms include an audio-frequency component within the envelope corresponding to a given note, as illustrated in FIG. 5.

Figure 12:
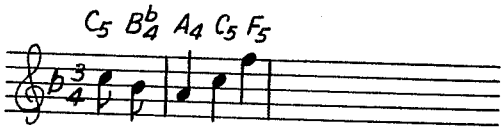
FIG. 12 is a portion of another musical score for another melody.
Figure 13:
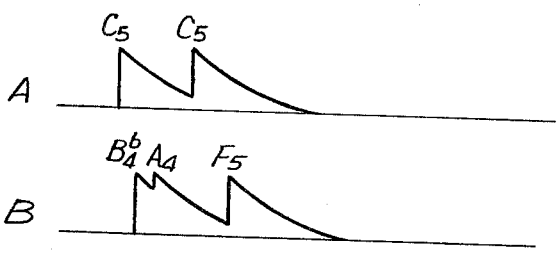
FIG. 13 shows wave forms associated with the musical score of FIG. 12.

Though the intervals of respective notes are different from one another by a whole step or more in the melody of FIG. 10, in the melody of FIG. 12, the second note is different from the third note by only a half step. In this case, another method for producing notes is shown in FIG. 13. This method is acoustically efficient, that is, consecutive notes only a half step apart may be generated in the same note-producing circuit.

In the embodiments described above with relation to FIGS. 2, 6 and 7, each note-producing circuit played every consecutive note in a melody. In the alternative embodiment of FIGS. 9 through 13, each note-producing circuit generally played only alternate notes of the melody. In FIG. 9, a note produced in one note-producing circuit can persist during the playing of all or part of a note produced in the other note-producing circuit. This overlapping of notes and the longer persistence of notes give a generally pleasing acoustical effect.

In the alternative embodiment of FIG. 9, it should be understood that the envelope circuits 407, 407' perform the same functions as described above in relation to FIG. 1, in that the generally rectangular output of the programmable counters 405, 405' can be modified to either sinusoidal or saw-tooth wave forms, and envelopes are applied using circuits, for example, as illustrated in FIG. 3 and described above.

With the exception of the electroacoustical transducer 409, all circuit elements can be formed on integrated circuit chips. This invention can be widely applied to portable electronic products as well as industrial electronic products. In a timepiece having an electronic sound-producing function, the tone generator circuit of this embodiment can be incorporated by integrating this circuit on the same circuit chip with the timekeeping functions.

Figure 14:
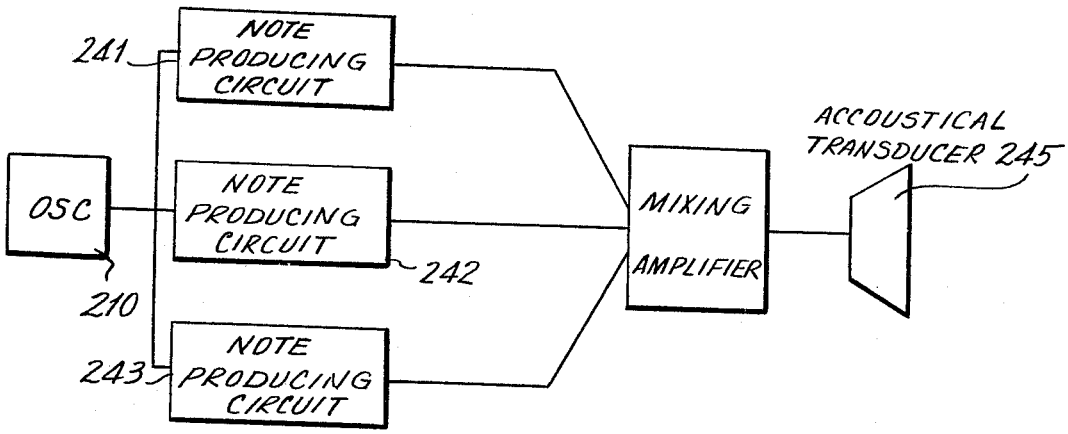
FIG. 14 is a functional block diagram of an alternative embodiment of an electronic tone generator of this invention.

Another alternative embodiment of a tone generator of this invention is illustrated in FIG. 14. Therein, the electronic tone generator is provided with three note-producing circuits 241, 242, 243, each circuit being similar to those used in FIGS. 1, 8 and 9 for production of notes. Electric signal wave forms produced by respective note-producing circuits 241, 242, 243 are amplified in a mixing amplifier circuit 244 and then are propagated as an audible musical sound by means of an electroacoustical transducer 245. Each note-producing circuit produces notes as follows.

Figure 15:
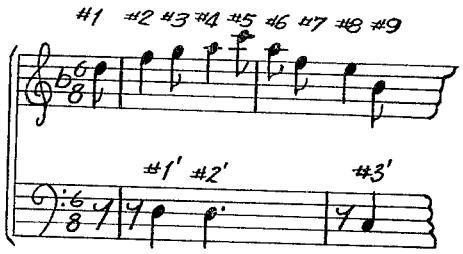
FIG. 15 shows the musical score suitable for use with the electronic tone generator of FIG. 14.

When providing a primary and a secondary melody as shown, for example, by FIG. 15, the first scale-producing circuit 241 produces notes identified as #1, #3, #5, #7 and #9 of the primary melody. The second scale-producing circuit 242 produces notes #2, #4, #6 and #8 of the primary melody. The third scale-producing circuit 243 produces notes #1', #2' and #3' of the secondary melody.

Figure 16:
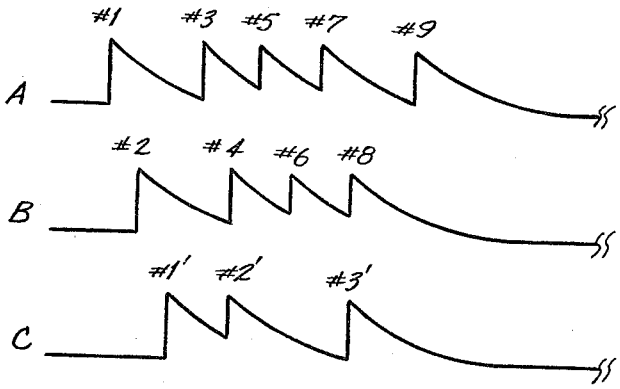
FIG. 16 shows wave forms associated with the musical scores of FIG. 15.

FIG. 16 shows the result when the notes, to which envelopes have been applied, are produced from respective note-producing circuits. Curve A is the output wave form produced from the first note-producing circuit 241. Curve B is the output wave form produced from the second note-producing circuit 242. Curve C is the output wave form produced from the third note-producing circuit 243. Thus, circuits 241, 242 are alternately producing notes of the primary melody, while the note-producing circuit 243 is playing every note consecutively of the secondary melody. Notes of the primary melody overlap as discussed above.

Although attack timings to produce notes are shown only by envelope wave forms in FIG. 16, in actuality, the wave forms include an audio frequency within the envelope corresponding to a given note as illustrated in FIG. 5. Though the basic wave is shown by a modulated rectangular wave in this case, a sine wave or saw-tooth wave form also is satisfactory, as discussed above.

Figure 17:
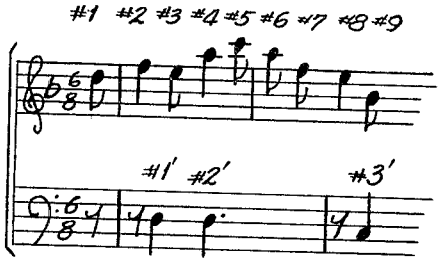
FIG. 17 is another musical score suitable for playing on the electronic tone generator of FIG. 14.
Figure 18:
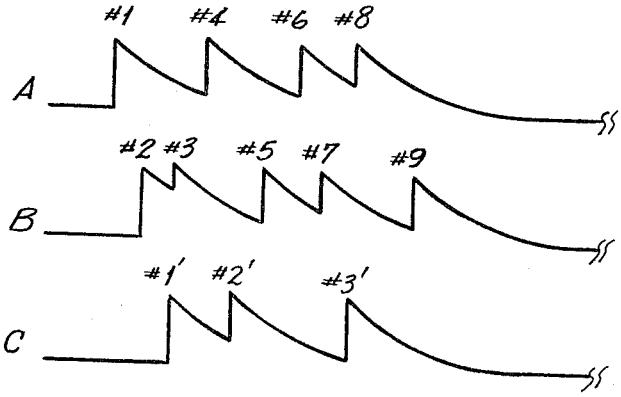
FIG. 18 shows wave forms associated with the musical scores of FIG. 17.

The intervals of adjacent notes are different from each other by a whole step or more in FIG. 15, but in the melody of FIG. 17, the difference between the notes #2 and #3 is only a half step. In this situation, the notes may be produced as shown in FIG. 18 with acoustical efficiency, that is, notes #2 and #3 are consecutively produced by the same note-producing circuit. Notes having a one-step or greater interval are produced, as stated above, alternately by the two primary melody note-producing circuits.

It should be understood that in the embodiment of FIG. 14, the note signals are given envelopes as well as wave form, and the circuit of FIG. 3 is used to produce note envelopes. Also as stated above, the wave-form envelopes are composed only of the attack and release portions. It is possible, with greater circuit complication, to provide envelope wave forms composed of attack, decay, sustenance and release. It is desirable that the time constants of the envelope circuits are such as to provide for overlapping notes in the primary melody.

The combination of the primary and secondary melody in the mixing amplifier 244 provides a pleasing acoustical output from the transducer 245. A loudspeaker is generally used as the transducer 245.

The last-described embodiment is provided with three note-producing circuits. Further improvement of tone quality of the outputted music can be achieved when more note-producing circuits are used, and the notes of the secondary melody may also be produced alternately on a pair of note-producing circuits with an overlapping effect. This further enhances the quality of the sound from the transducer 245. All special sound effects resulting from overlap, time delays and small frequency differences in note signals can be applied for an entire melody or pair of melodies or for only portions thereof, as commanded from memory.

As stated above with reference to FIG. 1, a single oscillator 210 (FIG. 14) may be used to provide the basic frequency signal from which every other frequency signal, that is, audio note frequency signals and note-timing signals, is derived by means, for example, of programmable counters in each note-producing circuit.

It will thus be seen that the objects set forth above, and those made apparent from the preceding description, are efficiently attained, and since certain changes may be made in the above constructions without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic tone generator comprising:

at least one first signal-generating oscillator circuit;

at least two note-producing circuits, each note-producing circuit including a memory circuit for storing note and time data for each note, a first programmable counter circuit for variably dividing pulses outputted by said first signal-generating oscillator circuit to produce in sequence different notes of selected frequencies and selected durations in response to sequential reading of said data in said memory circuit, the note output of each note-producing circuit being produced independently of the note output of the other note-producing circuit, but said output notes being interrelated to produce a single musical effect;

means to mix and amplify note wave forms produced by said note-producing circuits; and an electroacustic transducer receiving the output of said mixing and amplifying means and outputting audible sound having a special sound effect.

2. The electronic tone generator as claimed in claim 1, wherein said note-producing circuits are adapted to produce the same notes in the same sequence from said at least two note-producing circuits, and said output notes are interrelated to provide a time difference occurring between the same notes produced by each note-producing circuit, whereby an echo effect is produced in said audible sound.

3. The electronic tone generator as claimed in claim 1, wherein said note-producing circuits are adapted to produce substantially the same notes in the same sequence from said at least two note-producing circuits, and said output notes are interrelated to provide a small audio-frequency difference occurring between said substantially same notes produced by each note-producing circuit, whereby a beat frequency is introduced into said audible sound.

4. The electronic tone generator as claimed in claim 3, wherein said small audio-frequency difference is in the range of 3–30 Hz.

5. The electronic tone generator as claimed in claim 3 or 4, wherein said frequency difference raises the audio frequency of the note output of one note-producing circuit above the true note frequency.

6. The electronic tone generator as claimed in claim 1, wherein said output notes are interrelated in that said memory circuits are adapted to produce successive notes of the same melody alternately from two of said note-producing circuits.

7. The electronic tone generator as claimed in claim 6, wherein each note produced by a note-producing circuit persists until the next note is initiated in the same note-producing circuit, whereby an overlapping of notes is provided as said two note-producing circuits alternately produce the notes of a melody.

8. The electronic tone generator as claimed in claim 2, 3, 6 or 7, and further comprising at least one note-producing circuit producing notes which are independent and not interrelated to the notes produced by said interrelated note-producing circuits, whereby two independent melodies may be outputted simultaneously with at least one melody including said special sound effect.

9. The electronic tone generator as claimed in claim 1, 2, 3 or 7, and further comprising circuit means in each note-producing circuit for controlling the duration of each note, said circuit means for controlling duration operating in response to said time data stored in said memory circuit.

10. The electronic tone generator as claimed in claim 9, and further including a second signal-generating oscillator circuit, and wherein each said circuit means for controlling note duration includes:

a second programmable counter dividing down said signals from said second oscillator circuit, the division ratio of said second programmable counter being variable in response to said time data stored in said memory;

an address counter receiving the output of said second programmable counter and outputting a signal to said memory whereby the memory address is advanced and data for the next successive note is input to said first and second programmable counters.

11. The electronic tone generator as claimed in claim 1, 2, 3 or 7, and further comprising a wave-shaping circuit in each of said at least two note-producing circuits, said wave-shaping circuit receiving the output of said first programmable counter and being adapted to modify said signal output to provide periodic waves having a wave form selected from the group including rectangular, sinusoidal and saw-tooth triangular wave forms.

12. The electronic tone generator as claimed in claim 11, wherein said wave-shaping circuit superimposes an amplitude-modulating envelope on the signal from said first programmable counter.

13. The electronic tone generator as claimed in claim 12, wherein said envelope includes an attack and a release portion of a note.

14. The electronic tone generator as claimed in claim 12, wherein said envelope is a slowly decaying wave form, whereby overlapping notes are produced when two note-producing circuits are generating alternate notes from the same melody.

15. The electronic tone generator as claimed in claim 8, and further comprising a wave-shaping circuit in each of said at least two note-producing circuits, said wave-shaping circuit receiving the output of said first programmable counter and being adapted to modify said signal output to provide periodic waves having a wave form selected from the group including rectangular, sinusoidal and saw-tooth triangular wave forms.

16. The electronic tone generator as claimed in claim 15, wherein said wave-shaping circuit superimposes an amplitude-modulating envelope on the signal from said first programmable counter.

17. The electronic tone generator as claimed in claim 16, wherein said envelope is a slowly decaying wave form, whereby overlapping notes are produced when two note-producing circuits are generating alternate notes from the same melody.

18. The electronic tone generator as claimed in claim 6 or 7, wherein successive notes of the same melody are at least a full step apart as read on a musical score.

19. The electronic tone generator as claimed in claim 1, wherein said output notes are interrelated in that said memory circuits are adapted to produce successive notes of the same melody alternately from two of said note-producing circuits when said successive notes are at least a step apart in the musical score, and to produce successive notes with the same melody from the same note-producing circuit when said successive notes are less than one step apart.

20. The electronic tone generator as claimed in claim 19, wherein each note produced by a note-producing circuit persists until the next note is initiated in the same note-producing circuit.

21. The electronic tone generator as claimed in claim 8, and further comprising circuit means in each note-producing circuit for controlling the duration of each note, said circuit means for controlling duration operating in response to said time data stored in said memory circuit.

22. An electronic tone generator comprising:

at least one first signal generating oscillator circuit;

a memory circuit for storing note and time data;

at least two note-producing circuits, each note-producing circuit including a first programmable counter circuit for variably dividing pulses outputted by said first signal generating oscillator circuit to produce in sequence different notes of selected frequencies in response to said data in said memory circuit;

circuit means for controlling the duration of each note, said circuit means for controlling duration operating in response to said time data stored in said memory circuit, said circuit means for controlling note duration including:

a second programmable counter dividing down said signals from said at least one first signal generating oscillator circuit, the division ratio of said second programmable counter being variable in response to said time data stored in said memory;

an address counter receiving the output of said second programmable counter and outputting a signal to said memory whereby the memory address is advanced and data for the next successive note is input to said first and second programmable counters.

23. The electronic tone generator as claimed in claim 22, wherein said signal from said second oscillator circuit has a period equal to the duration of the shortest note in the melodies to be played by said tone generator.

24. The electronic tone generator as claimed in claim 22, wherein each said circuit means for controlling note duration includes:

a second programmable counter dividing down said signals from said first signal-generating oscillator circuit, the division ratio of said second programmable counter being variable in response to said time data stored in said memory;

an address counter receiving the output of said second programmable counter and outputting a signal to said memory whereby the memory address is advanced and data for the next successive note is input to said first and second programmable counters.

25. The electronic tone generator as claimed in claim 24, wherein said signal from said first signal-generating oscillator circuit has a period equal to the duration of the shortest note in the melodies to be played by said tone generator.

26. The electronic tone generator as claimed in claim 24, and further comprising a wave-shaping circuit in each of said at least two note-producing circuits, said wave-shaping circuit receiving the output of said first programmable counter and being adapted to modify said signal output to provide periodic waves having a wave form selected from the group including rectangular, sinusoidal and saw-tooth triangular wave forms.

27. The electronic tone generator as claimed in claim 26, wherein said wave-shaping circuit superimposes an amplitude-modulating envelope on the signal from said first programmable counter.

28. The electronic tone generator as claimed in claim 22, and further comprising a wave-shaping circuit in each of said at least two note-producing circuits, said wave-shaping circuit receiving the output of said first programmable counter and being adapted to modify said signal output to provide periodic waves having a wave form selected from the group including rectangular, sinusoidal and saw-tooth triangular wave forms.

29. The electronic tone generator as claimed in claim 28, wherein said wave-shaping circuit superimposes an amplitude-modulating envelope on the signal from said first programmable counter.

* * * * *